US005979077A

United States Patent [19]

Schenkel

[11] Patent Number: 5,979,077

[45] Date of Patent: Nov. 9, 1999

[54] PROCESS FOR ATTACHING A SHOE UPPER TO A SOLE BY APPLYING A STRING, AND THE RESULTING SHOE

[76] Inventor: Decio Luiz Schenkel, Rua General Emilio Lucio Esteves, 1353, Taquara - RS, Brazil

[21] Appl. No.: 09/247,049

[22] Filed: Feb. 9, 1999

[30] Foreign Application Priority Data

Apr. 2, 1998 [BR] Brazil ..... 9800998

[51] Int. Cl.[6] ..... A43B 13/28

[52] U.S. Cl. ..... 36/12; 36/11; 12/142 T

[58] Field of Search ..... 36/11, 12, 21, 36/15; 12/142 T

[56] References Cited

U.S. PATENT DOCUMENTS

| | | | |
|---|---|---|---|
| 337,483 | 3/1886 | Cross | 36/12 |
| 2,413,824 | 1/1947 | Glassman | 36/12 |
| 2,510,236 | 6/1950 | Kutcher | 36/15 |

*Primary Examiner*—M. D. Patterson

[57] ABSTRACT

A shoe includes an upper with a lower edge, a sole with at least one transverse passageway and a peripheral slit, and a first string placed along the lower edge of the upper over the slit of the sole and stretched through at least one of the passageways in order to attach the upper to the sole while providing an attractive finish to the shoe. A second string can be inserted through another passageway to eliminate gaps between the first string and curved portions of the sole to further improve the fit and finish of the shoe.

2 Claims, 4 Drawing Sheets

FIG.1
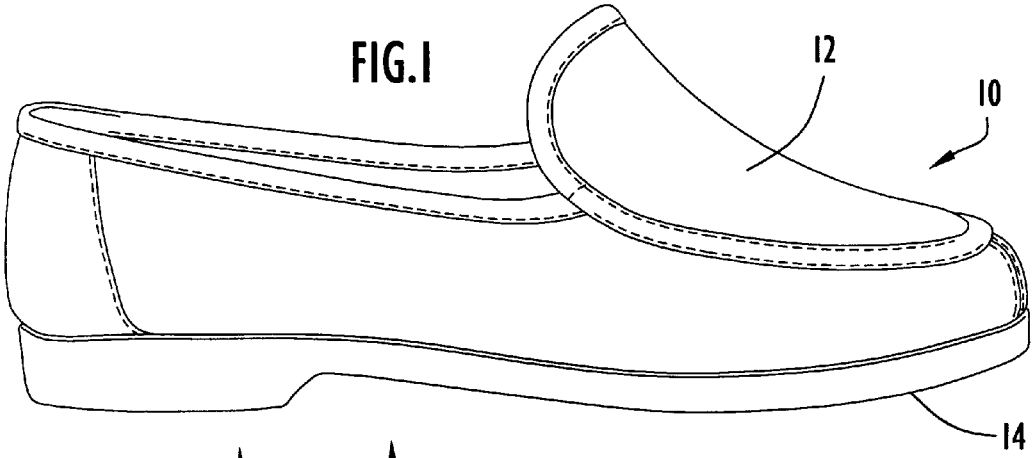
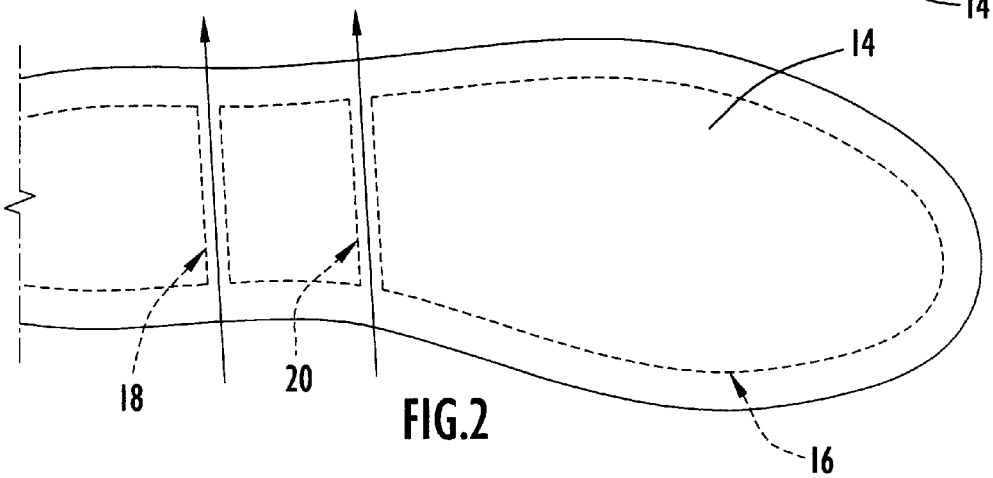
FIG.2
FIG.3
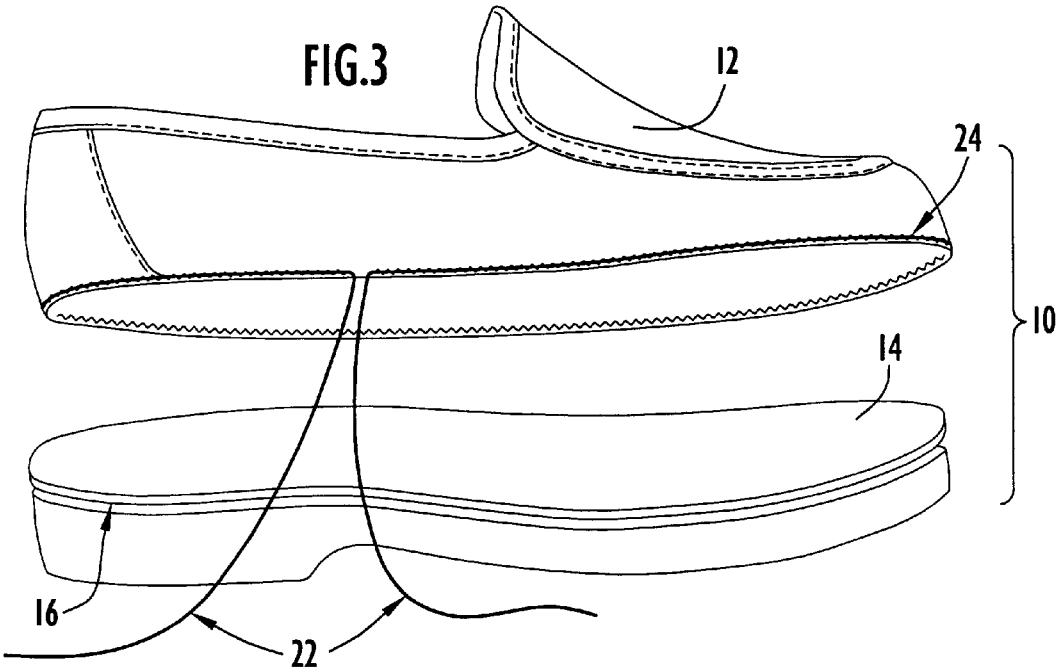

PROCESS FOR ATTACHING A SHOE UPPER TO A SOLE BY APPLYING A STRING, AND THE RESULTING SHOE

SUMMARY OF THE INVENTION

The present invention relates generally to shoes and, more particularly, to a method of attaching an upper to a sole using string and the resulting shoe.

The present invention is described herein with reference to a type of shoe commonly referred to as a loafer, that is, a step-in shoe in which the upper resembles a moccasin but is attached to a sole with a heel. It will be appreciated, however, that the inventive concept can be applied to any style of shoe including laced shoes and shoes having soles without a heel. In accordance with the present invention, the sole of the shoe (which, as mentioned above, can be a loafer, moccasin or any other type of shoe) is provided with two transverse passageways, generally parallel to each other, and an open peripheral groove or slit into which the lower edge of the shoe upper is inserted. The shoe upper is held in place by adjusting or cinching a first string extending around a lower edge of the upper and anchoring the string using a first of the transverse passageways. An optional second string is preferably passed through the second transverse passageway to anchor the first string at a second location to eliminate gaps caused by the curvature of the sole. The invention will be better understood by way of the accompanying drawings, represented by figures briefly described as follows, when examined in conjunction with the detailed description provided below.

BRIEF DESCRIPTION OF THE DRAWINGS

FIG. 1 is a perspective view of a shoe constructed in accordance with the present invention.

FIG. 2 is a top view of a shoe sole with a peripheral groove and two transverse passageways for use in constructing a shoe with string in accordance with the present invention.

FIG. 3 is an exploded perspective view of the shoe of FIG. 1 showing the upper spaced apart from the shoe sole.

DESCRIPTION OF THE PREFERRED EMBODIMENTS

Figure 4:
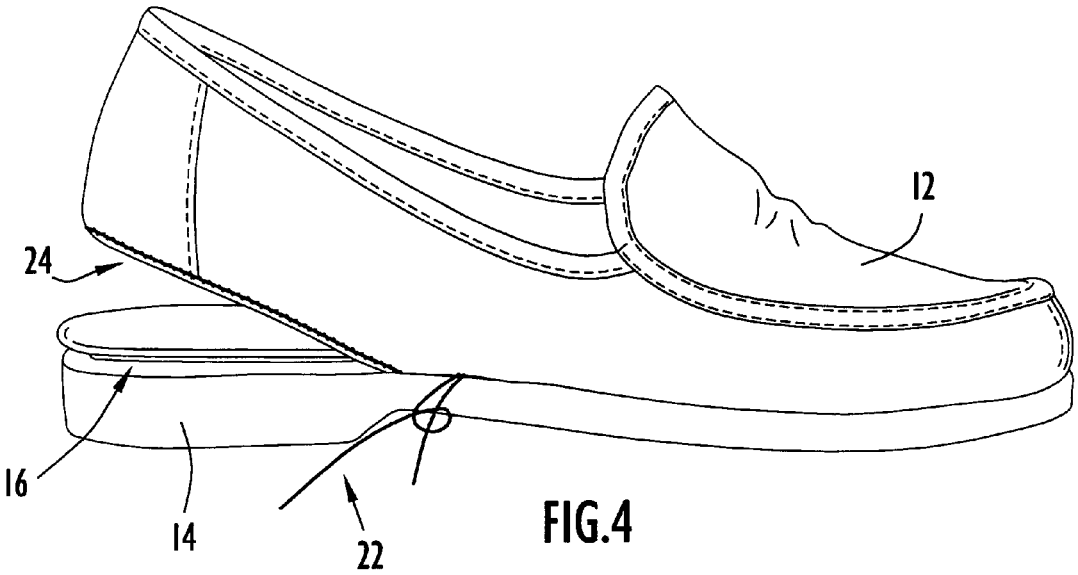
FIG. 4 is a perspective view of the upper being attached to the sole to form a shoe in accordance with the present invention, the attachment being partially completed.

A shoe 10 constructed in accordance with the present invention is illustrated in FIG. 1 as a loafer having an upper 12 resembling a moccasin and a sole 14 with a heel. It will be appreciated, however, that the present invention can be used to construct any style of shoe. As can be seen in FIG. 2, an open groove or slit 16 is formed about the periphery of sole 14 and a pair of longitudinally spaced passageways 18 and 20 extend transversely through the sole in generally parallel relation to one another. As can be seen in FIG. 3, a first string 22 extends around a lower edge 24 of upper 12 (e.g., through a tubular pocket or stitching as shown) and terminates in a pair of free ends which dangle from one side of the upper.

Figure 5:
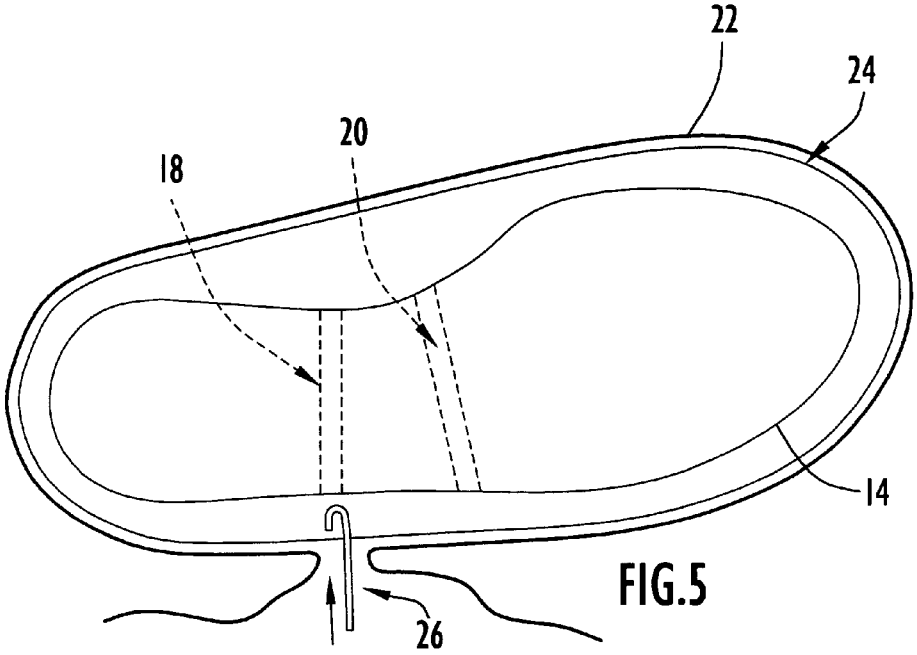
FIG. 5 is a view of the shoe as seen from below, showing the fastening string ready to be applied.
Figure 6:
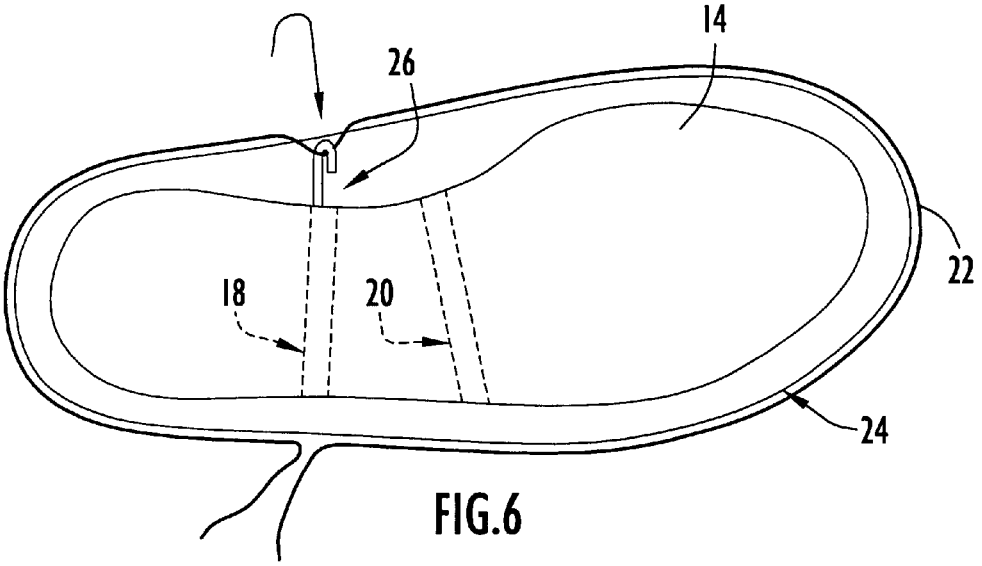
FIGS. 6 to 10 are views of the sole lower face, illustrating the several steps for the assembly of the shoe of the invention.
Figure 7:
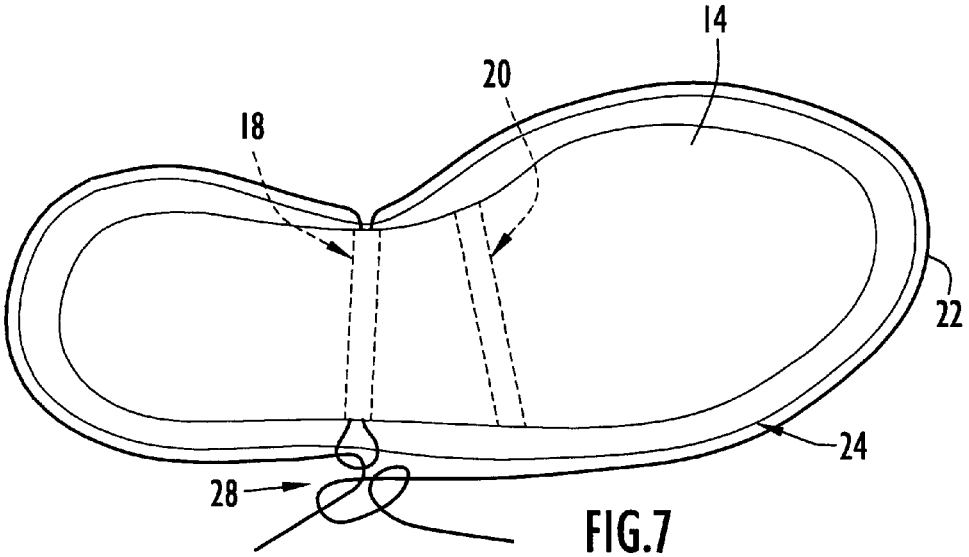
Figure 8:
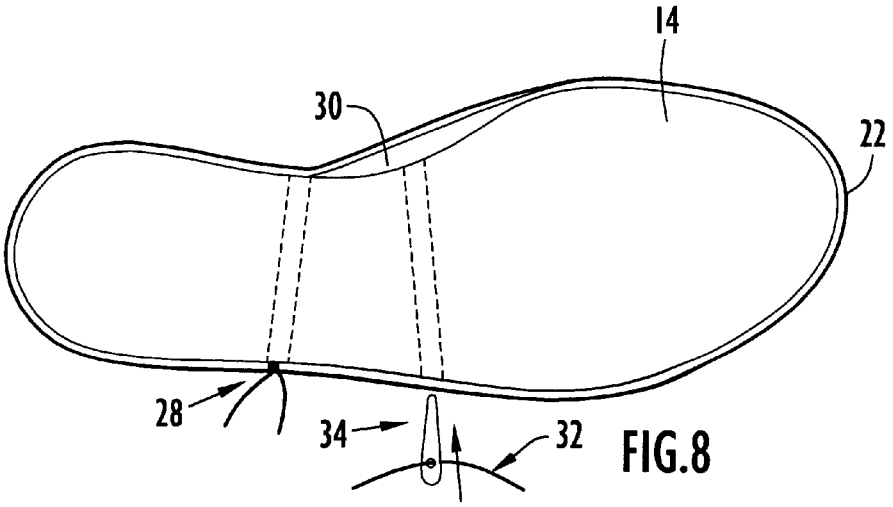
Figure 9:
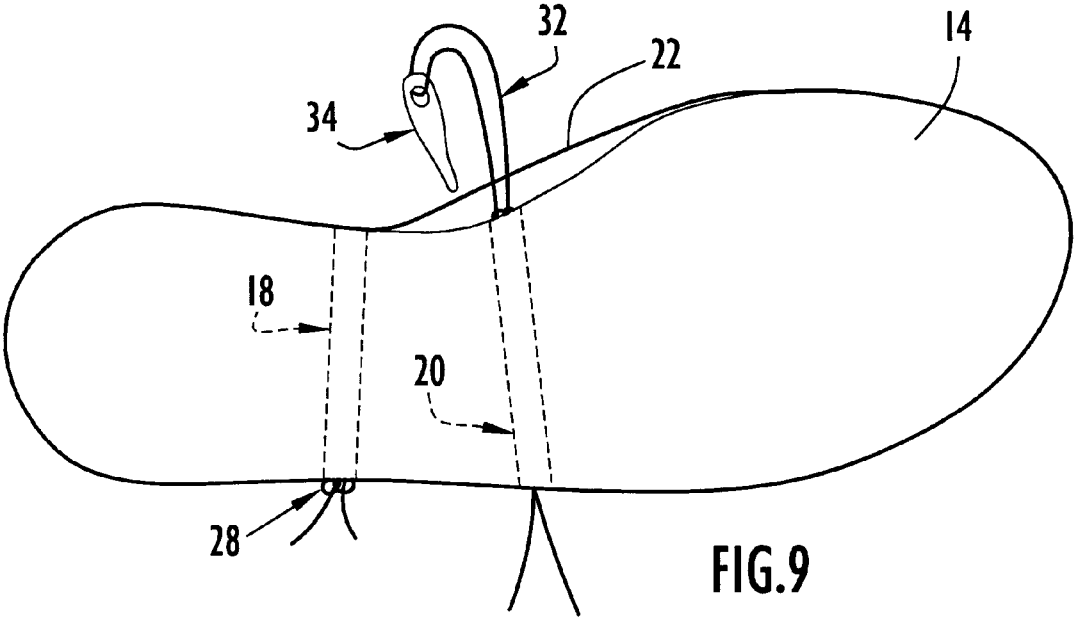
Figure 10:
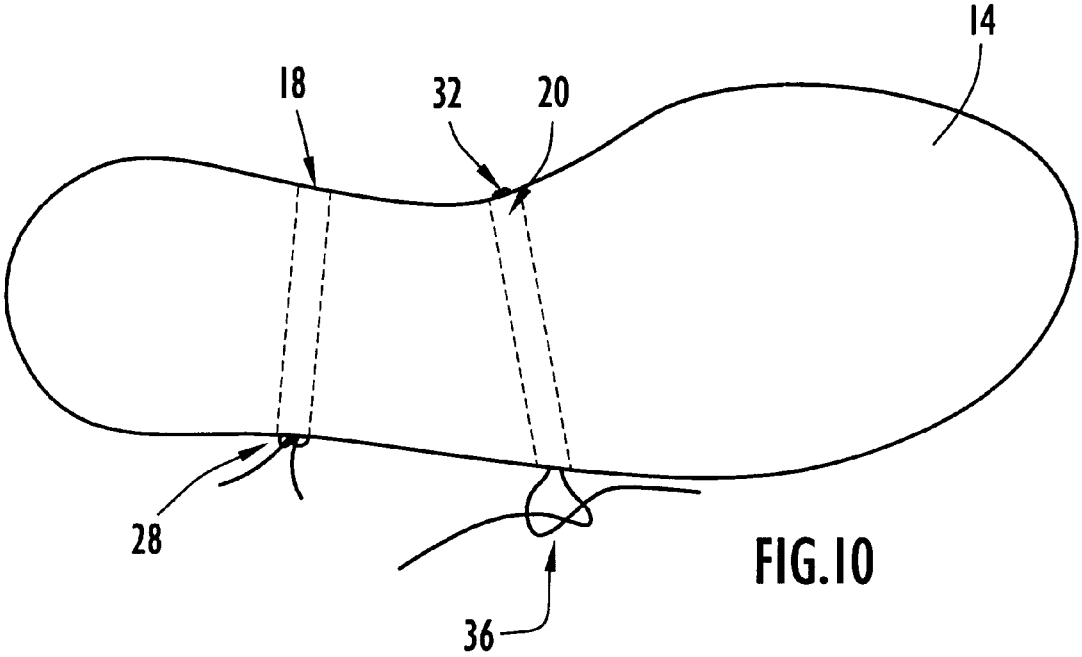

Upper 12 is attached to sole 14 to form a shoe by inserting lower edge 24 of the upper into slit 16 of the sole and fastening the edge against the slit using string 22. In FIG. 4, shoe 10 is shown partially assembled with string 22 not yet stretched over the full extension of edge 24 of upper 12. More specifically, the method according to the present invention involves positioning lower edge 24 of upper 12 around the periphery of sole 14 as shown in FIG. 5 so that the lower edge of the upper can be pressed against peripheral slit 16. Edge 24 of the upper is fastened against or drawn into the slit by inserting a hook 26 through passageway 18 as shown in FIG. 5 and using the hook to pull string 22 through the passageway as shown in FIG. 6 in order to provide stretching or tensioning of the string around the edge of the upper as shown in FIG. 7. As string 22 is pulled, lower edge 24 of upper 12 is drawn inwardly or cinched into slit 16, and the part of the string pulled through transverse passageway 18 is anchored, for example by forming a string knot 28 using the free ends of the string as shown in FIG. 7. Dependent upon the curvature of the sole, stretching of string 22 can result in a space or gap 30 between the first string and the most curved part of the sole, for example as shown in FIG. 8. Space 30 can be eliminated by inserting a second string 32 through passageway 20, for example using an anchoring part or needle 34 as shown in FIG. 8, and using the second string to loop around first string 22 as shown in FIG. 9 so that the first string can be pulled into or through transverse passageway 20. When space 30 is eliminated, the portion of the first string pulled into or through transverse passageway 20 is anchored, for example by forming a string knot 36 using free ends of second string 32 as shown in FIG. 10. String 22 may thus be perfectly adjusted to the peripheral slit 16 of sole 14, providing a perfect finish to the shoe. FIGS. 9 and 10 show the final steps of fitting and finishing of upper 12 to sole 14 by way of the transverse passageways 18 and 20, and peripheral slit 16, using a first string 22 and an additional, second string 32.

Small alterations during the assembly method, as well as with regard to materials that serve to accomplish the invention, under the inventive concept set forth, are also intended to be part of the protection provided by the accompanying claims. For example, various materials can be used to form the upper and the sole including, but not limited to, leather, canvas and synthetic materials. The sole can have any number of passageways formed therethrough in parallel or at any angle relative to one another. The string can be formed of any suitable material including, but not limited to, leather, cotton or synthetic materials. Free ends of the string can be anchored by formation of a knot or by use of clips, adhesives or other types of anchoring techniques. It is also important to emphasize that the present inventive concept can be applied to any type of shoe including, but not limited to, loafers and moccasins.

What is claimed is:

1. A process for attaching a shoe upper to a sole by applying a string, comprising the steps of: (a) preparing the shoe upper to be used; (b) preparing a sole having a peripheral slit and transverse passageways; (c) adjusting a first string around the lower edge of the upper; (d) pulling the first string through the passageway and anchoring it at the position of the peripheral slit; (e) inserting an anchoring part through the passageway and pulling the first string by way of a second string in order to eliminate a space which resulted when the string was stretched through the passageway over the curved part of the sole; and (f) forming a knot at all ends of the strings.

2. A shoe comprising a shoe upper with a lower edge, a sole provided with two transverse passageways and a peripheral slit, a first string disposed around said lower edge of said upper, and a second string, wherein said first string is pressed against said lower edge and inserted into said peripheral slit, keeping tensioned within this slit, and said second string is used to impart a close fit between said upper and said sole.

* * * * *